US005587187A

United States Patent [19]

Benade

[11] Patent Number: 5,587,187

[45] Date of Patent: Dec. 24, 1996

[54] BRICK PRESS

[76] Inventor: Marthinus J. Benade, Plot 4, Glen Dayson, Roodepoort, South Africa

[21] Appl. No.: 384,267

[22] Filed: Feb. 1, 1995

[30] Foreign Application Priority Data

Feb. 2, 1994 [ZA] South Africa ..... 94/0706

[51] Int. Cl.[6] ..... B28B 3/04; B30B 1/04; B30B 1/26

[52] U.S. Cl. ..... 425/409; 425/406; 425/412; 425/416; 425/422

[58] Field of Search ..... 425/406, 409, 425/412, 413, 416, 422

[56] References Cited

U.S. PATENT DOCUMENTS

| | | | |
|---|---|---|---|
| 957,174 | 5/1910 | Taylor | 425/409 |
| 2,069,439 | 2/1937 | Hanney | 425/409 |
| 2,770,863 | 11/1956 | Smith | 425/409 |
| 2,980,951 | 4/1961 | Brown | 425/409 |
| 3,577,591 | 5/1971 | Ricards et al. | 425/409 |
| 3,741,706 | 6/1973 | Conley et al. | 425/409 |
| 5,056,999 | 10/1991 | Lewis et al. | 425/409 |

*Primary Examiner*—James P. Mackey
*Attorney, Agent, or Firm*—Townsend and Townsend and Crew

[57] ABSTRACT

The invention concerns a brick press which can be operated manually to produce coherent bricks from appropriate loose material. The brick press has a brick pressing chamber (12) which can be charged with the loose material. The pressing chamber is defined by side walls (16), a bottom wall in the form of a movable platen (18) and a top wall in the form of an openable and closable lid (20). A lever mechanism (40) can be operated, when the lid is closed, firstly with a cam action to move the platen towards the lid so as to apply initial compression to loose material in the pressing chamber and thereafter with a levering action to apply final compression to the initially compressed material in the pressing chamber.

9 Claims, 4 Drawing Sheets

48
54
52
40
42
10
44
46
56
50
38
30
60
100
80
60
90
16
64
24
62
22
36
26
24

82
28
30
28
20
78
30
80
60
62
40
76
42
56
50
10
16
64
44
16
24
12
91
18
52
54
48
46
38
24
90
32
34
26
36
32

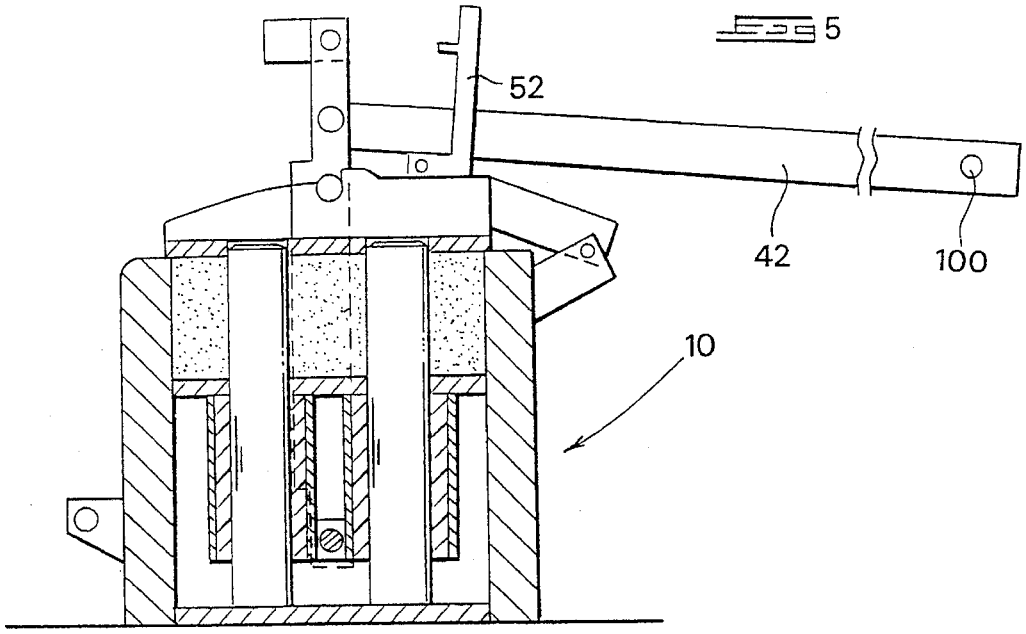
5
52
42
100
10
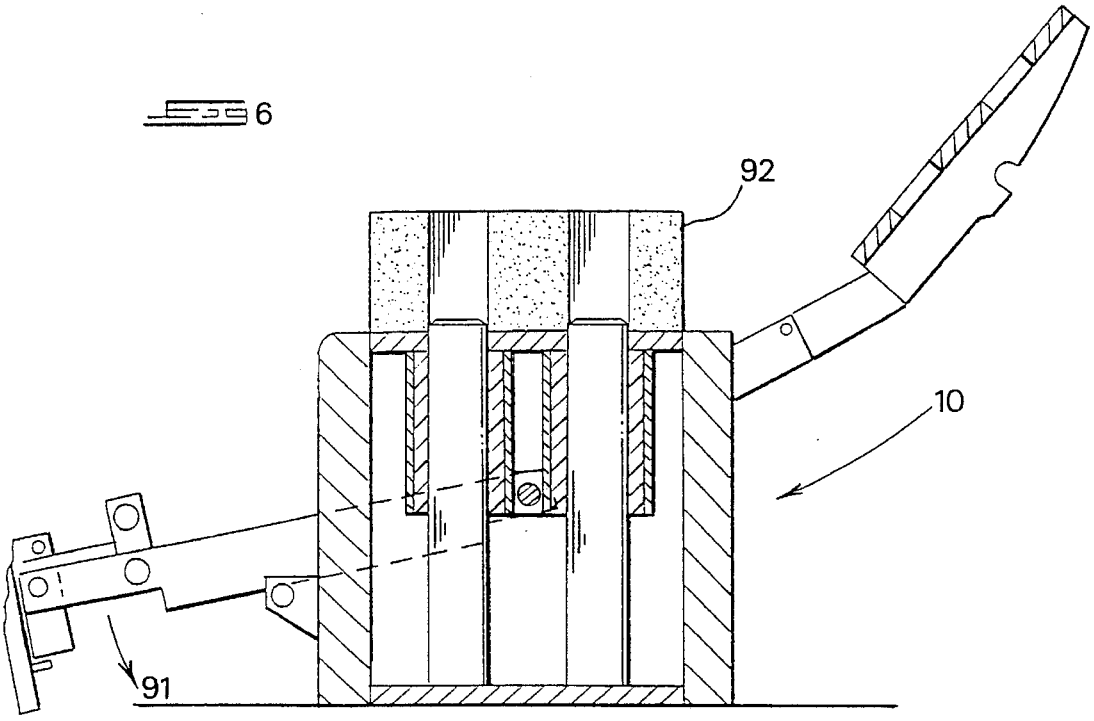
6
92
10
91

BRICK PRESS

BACKGROUND TO THE INVENTION

This invention relates to a brick press.

It is believed that one of the ways in which required volumes of low cost housing can be provided is by providing potential home-owners with the means to manufacture at least some of the building materials which they will need to construct a dwelling. It is an object of the present invention to provide a brick press by means of which individuals will be able to manufacture bricks suitable for use in the construction of a dwelling.

SUMMARY OF THE INVENTION

According to the present invention there is provided a brick press comprising:

a brick pressing chamber which can be charged with loose material that is to be pressed to form a brick and which is defined by side walls, a bottom wall and a top wall, the bottom wall being provided by a platen which is movable towards and away from the top wall, and the top wall being provided by a lid which is movable between a closed position in which it closes the chamber and an open position in which it opens the chamber, and a lever mechanism operable, with the lid in a closed position, firstly with a cam action to move the platen towards the lid so as to apply initial compression to loose material in the pressing chamber and secondly with a levering action to move the platen further towards the lid to apply final compression to the initially compressed material in the pressing chamber.

In the preferred embodiment, the lever mechanism includes a lever attached pivotally relative to the platen, a cam follower on the lever and a cam surface on the lid, the lever being pivotable relative to the platen in a first direction to cause movement of the cam follower over the cam surface with the result that the platen is moved towards the lid to apply initial compression to the material in the pressing chamber.

The lever may comprise a lever bar carrying the cam follower, a lever member to which the lever bar is pivoted and which is itself connected pivotally relative to the platen and a releasable latch for connecting the lever bar to the lever member so that the lever bar and lever member move together. The brick press then includes a formation on the cam surface for engaging and stopping the cam follower at a certain stage during pivoting of the lever, the cam follower then acting as a fulcrum for the lever bar when the latch is released so that subsequent pivotal movement of the lever bar in the first direction causes levered movement of the lever member resulting in movement of the platen further towards the lid to apply final compression to the material in the pressing chamber.

Conveniently, the lever is operable, with the lid in an open position, to apply a levering action to the platen to move the platen in a direction to drive the compressed material, in the form of a brick, out of the pressing chamber.

The press may also include a frame supporting the pressing chamber and a formation on the frame acting as a fulcrum for the lever, when the lever is pivoted relative to the platen in a second direction opposite to the first direction, so that the lever applies a levering action to the platen to cause the platen to drive the compressed material, in the form of a brick, out of the pressing chamber.

Preferably, the lever has laterally projecting handles whereby the lever can be gripped and operated manually.

The preferred brick press also comprises upright void forming guides in the brick pressing chamber, the void-forming guides passing through the platen to guide movement of the platen. In this case, the lid may have apertures therein in which the void-forming guides locate when the lid is in its closed position. Also, there may be bearings mounted slidably on the void-forming guides, the lever being connected pivotally to the bearings.

BRIEF DESCRIPTION OF THE DRAWINGS

The invention will now be described in more detail, by way of example only, with reference to the accompanying drawings.

In the drawings:

FIGS. 2 to 5 show cross-sectional views illustrating successive stages during the brick pressing operation;

FIG. 6 shows a cross-sectional view illustrating the ejection of a pressed brick.

DESCRIPTION OF A PREFERRED EMBODIMENT

Figure 1:
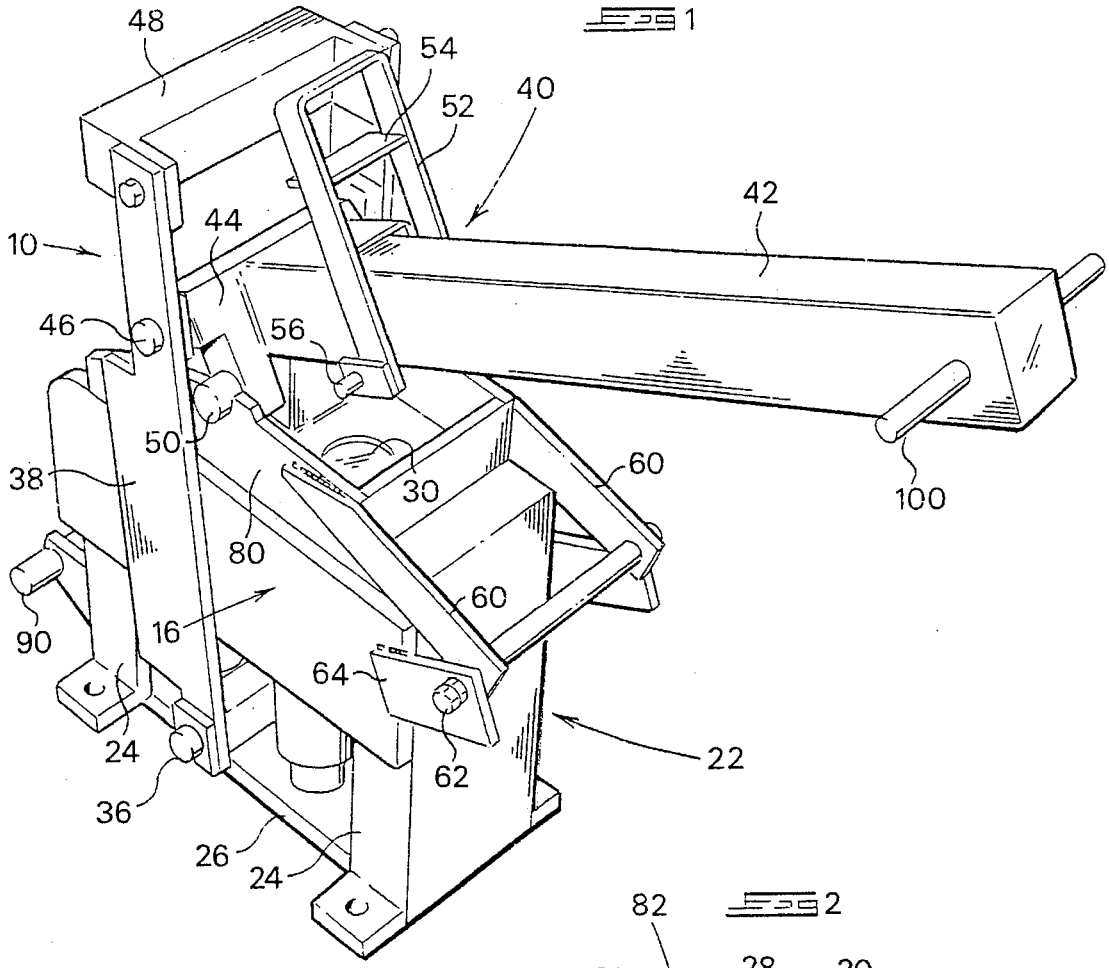
FIG. 1 shows a perspective view of a brick press of the invention at an intermediate stage during a brick pressing operation.

FIGS. 1 to 6 illustrate a brick press 10 according to the invention. The brick press 10 has a pressing chamber, indicated generally with the numeral 12. The pressing chamber 12 is rectangular in horizontal cross-section and is defined by side walls 16, a bottom wall in form of a movable platen 18 and top wall in the form of a pivoted lid 20. The pressing chamber is supported by a frame 22 that includes upstanding end members 24 and a base plate 26.

Two void-forming guides 28 of round cylindrical shape have their lower ends fixed to the base plate 26 and extend upwardly through the pressing chamber 12. As illustrated, the two guides 28 pass through the platen 18 and locate in apertures 30 in the lid 20 when the lid is closed. Cylindrical bearing structures 32 packed with low frictional material 34 are located slidably on the guides 28 and have their upper ends connected to the underside of the platen 18. A cross-bar 36 is connected rigidly to the structures 32 and extends transversely between them. Side plates 38, forming a lever member of a lever mechanism indicated generally with the numeral 40, are pivoted to the ends of the cross-bar.

The lever mechanism also includes a long lever bar 42 which extends from a member 44 mounted pivotally between the side plates 38 on pivots 46.

A bracket 48 is mounted between the upper extremities of the side plates 38 as illustrated. The member 44 carries laterally projecting cam followers in the form of stubs 50 of round cylindrical shape, and a latching bracket 52 which is generally of U-shape and which includes a cross-member 54, is loosely pivoted to a pin 56 on the bar 42.

Arms 60 extend from the lid 20 and are pivoted by a pivot pin 62 to brackets 64 projecting from the pressing chamber 12. This arrangement enables the lid 20 to pivot from the closed position seen in FIGS. 1 to 5 to the open position seen in FIG. 6. In the closed position, the lid closes off the upper end of the pressing chamber 12 while in the open position of FIG. 6, the lid opens the upper end of the pressing chamber.

Figure 7:
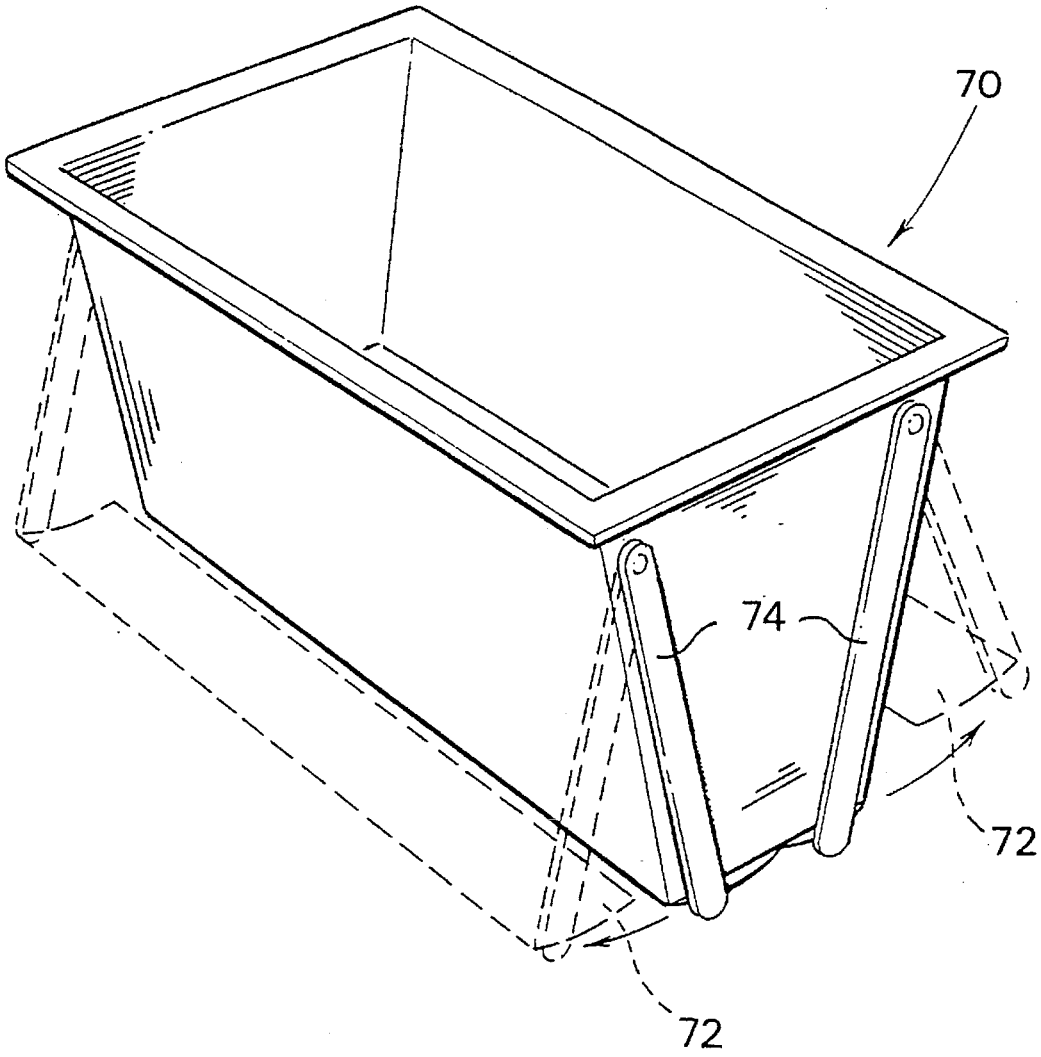
FIG. 7 shows a perspective view of a charging hopper.

As a first step in the pressing of a brick, the pressing chamber is charged with a volume of compressible material 63. In a typical case, this material will consist of loose, slightly damp, fine soil with a small addition of cement. The material may also include fly ash as a filler. In order to charge the pressing chamber, the material is introduced by hand or shovel into the hopper 70 seen in FIG. 7, until the hopper is full to its upper edge. The floor of the hopper is defined by a pair of gates 72 which are carried by pivotally mounted arms 74 and which are gravity-biased to a closed position.

With the lid 20 in the open position, the hopper is placed over the open upper end of the pressing chamber. The gates 72 are pulled apart from one another to open the bottom of the hopper and allow the material to drop into the pressing chamber.

Any excess material in the chamber is scraped off, so that the chamber is full of loose material to its upper edge. It will be appreciated that the loose material completely surrounds the upstanding void-forming guides 28 inside the pressing chamber.

Figure 2:
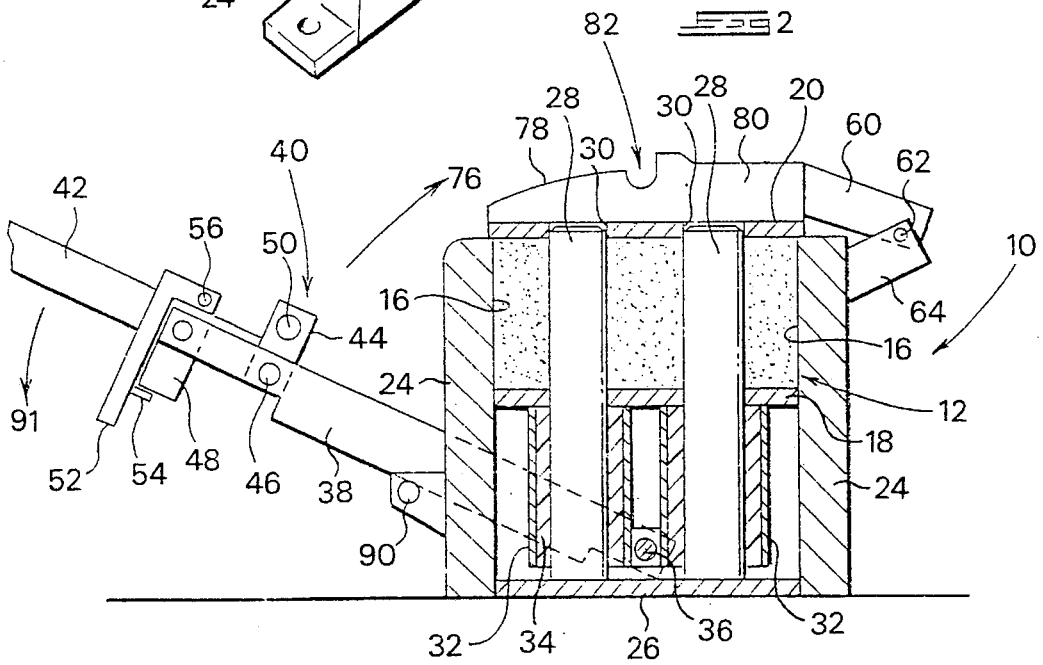
Figure 3:
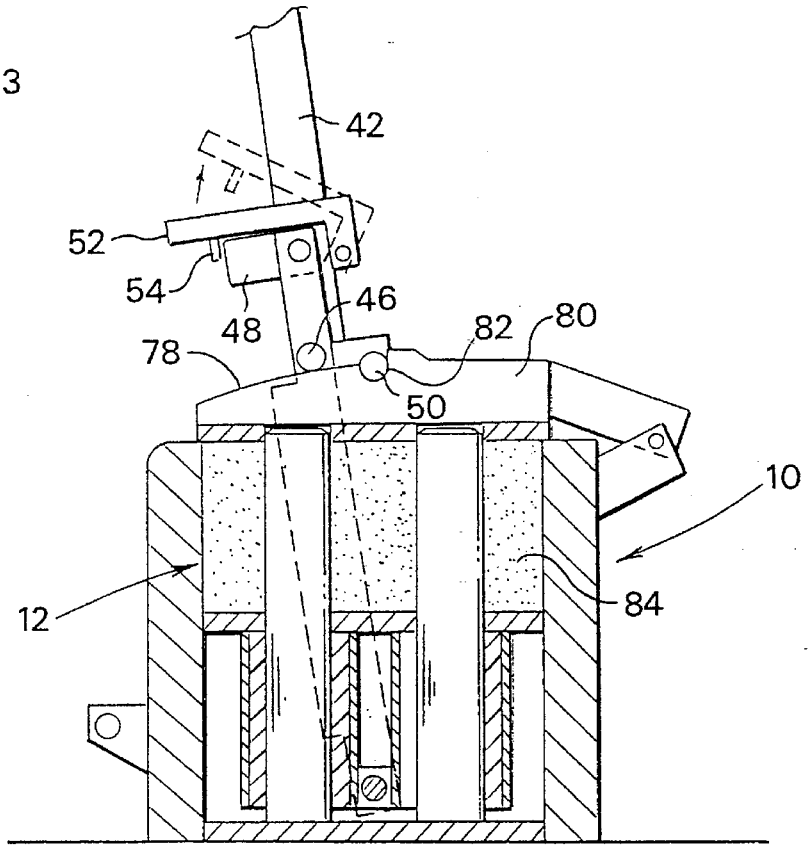
Figure 4:
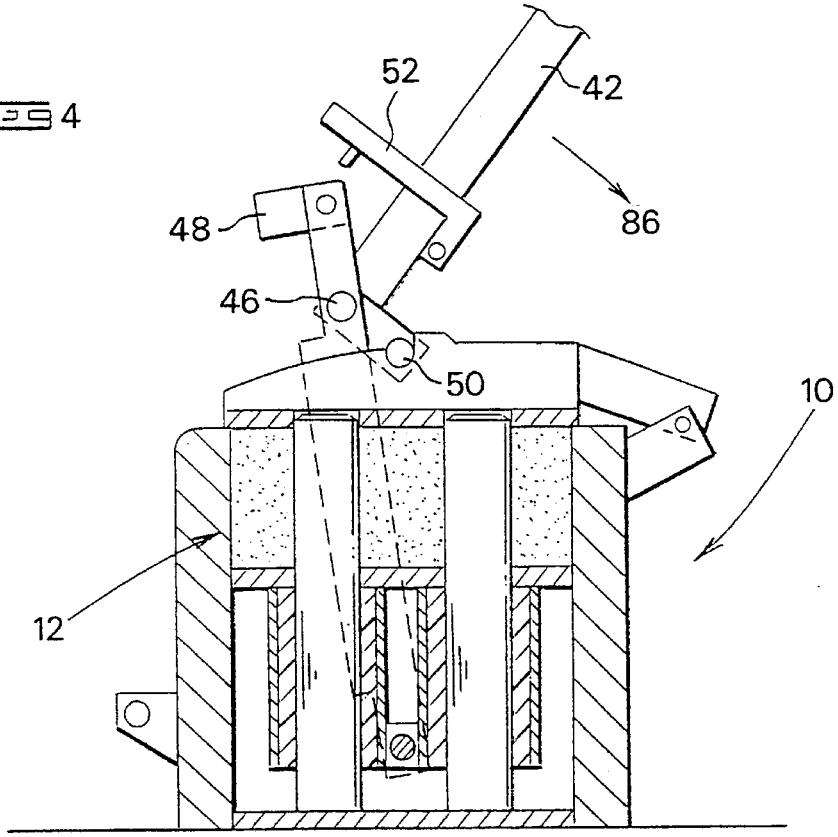

The lid 20 is then pivoted to the closed position of FIG. 2, so that the upper ends of the void-forming guides 28 locate in the apertures 30. The lever bar 42 is then pivotally raised as indicated by the arrow 76. The stubs 50 encounter and ride over the convexly curved, upper cam surfaces 78 of plates 80 which are mounted on the lid, until eventually the stubs locate in part-circular recesses 82 in the plates 80. This situation is seen in FIGS. 1 and 3. During the movement of the stubs over the curved surfaces 78, the side plates 38 are lifted.

The upward movement of the side plates is accompanied by corresponding upward movement of the cross-bar 36, bearing structures 32 and platen 18. The upward movement of the platen causes initial compression of the material 63.

During the above-described movement of the bar 42, the cross-member 54 of the latching bracket 52 is engaged with the bracket 48 as seen in FIG. 2, so that the side plates and lever bar move together. When the stubs 50 have located in the recesses 82, the latching bracket 52 is pivotally raised to disengage the cross-member 52 from the bracket 48, as indicated by movement from the full line position to the broken line position in FIG. 3. The lever bar 42 is then pivoted further as indicated by the arrow 86 in FIG. 4.

Pivotal movement takes place about the stubs 50, the resulting lever action causing further upward movement of the side plates 38, cross-bar 36, bearing structures 32 and platen 18.

At this stage, a considerable compressive force is applied to the material in the pressing chamber. In practice, there is a very large mechanical advantage resulting from the length of the bar 42 compared to the small distance through which the platen is raised. In use of a prototype brick press of the illustrated type and with an adequate length of bar and a downward force applied by the full weight of an 80 kg operator, an upward force of 50 t was applied by the platen. The applied force increases as the mechanism approaches a top dead centre position, in which the pivots 46 are vertically above the stubs 50, since the upward movement of the platen is at this stage minimal for a large movement of the bar.

Eventually, the mechanism goes over-centre, i.e. passes through the top dead centre position. Very shortly after this stage is reached, the latching bracket 52 abuts the upper surface of the lid 20 as seen in FIG. 5. This situation marks the end of the pressing cycle.

It will therefore be appreciated that the loose material in the pressing chamber is initially compressed by the cam action as the stubs 50 ride over the curved cam surface 78, and is thereafter subjected to full compression by the levering action as the lever bar is pivoted about the fulcrum established by location of the stubs 50 in the recesses 82.

After the pressing cycle the bar 42 is pivoted back to the FIG. 2 position in which the side plates 38 rest on a transverse fulcrum bar 90 carried by the frame of the press. The lid 20 is swung open and a downward levering force is applied to the end of the bar, in the direction indicated in FIGS. 2 and 6 by the numeral 91. The bar applies an upward force to the cross bar 36, bearing structures 32 and platen 18. The upward movement of the platen 18 drives the pressed brick 92 out of the open upper end of the pressing chamber. This is shown in FIG. 6. The brick 92 can now be lifted away manually and stacked for an appropriate curing period, whereafter it can be used in the building of a structure.

Although not shown in the drawings, the upper surface of the platen and the lower surface of the lid can be provided with a relief profile designed to form, in the pressed brick, a three-dimensional interlocking pattern. In this way, blocks which are designed to interlock with one another can be produced. The extremely high pressing force generated by the press ensures that dimensional accuracy of the brick, necessary for accurate interlocking and dry stacking of bricks, can be achieved.

A major advantage of the press as described above is the fact that it affords unskilled persons with limited resources the ability to manufacture their own building bricks at modest cost, using readily available materials.

Added to this the entire pressing operation, including manoeuvring of the bar 42, is carried out manually, and possibly by a single person only.

It will be noted that the end of the bar 42 has laterally projecting handles 100 to facilitate single-handed operation.

A further important advantage is the fact that the void-forming guides form cylindrical passages through the pressed bricks. When the bricks are then laid in an appropriate pattern to form a wall, the passages align with one another. In a case where the bricks are dry-stacked, the wall can be bound together and strengthened by pouring wet concrete into some of the aligned passages, thereby forming vertical concrete columns at spaced apart positions in the wall. The passages can also accommodate electrical and other services. Added to this, the passages facilitate gripping and manual handling of the brick.

The bricks which are produced by the press of the invention will generally have dimensions which are convenient for the construction of walls and other building structures. It will nevertheless be appreciated that the dimensions can vary widely from case to case, so that in some cases the bricks which are produced are in the form of blocks which are substantially larger than conventional building bricks.

What is claimed is:

1. A brick press comprising:

a brick pressing chamber which can be charged with loose material that is to be pressed to form a brick and which is defined by side walls, a bottom wall and a top wall, the bottom wall being provided by a platen which is movable towards and away from the top wall, and the top wall being provided by a lid which is movable between a closed position in which said lid closes the chamber and an open position in which it opens the chamber, and a lever mechanism operable, with the lid in said closed position, firstly with a cam action to move the platen towards the lid so as to apply initial compression to loose material in the pressing chamber and secondly with a levering action to move the platen further towards the lid to apply final compression to the initially compressed material in the pressing chamber, wherein the lever mechanism includes a lever attached pivotally relative to the platen, a cam follower on the lever and a cam surface on the lid, the lever being pivotable relative to the platen in a first direction to cause movement of the cam follower over the cam surface with the result that the platen is moved towards the lid to apply initial compression to the material the pressing chamber.

2. A brick press according to claim 1 wherein the lever comprises:

a lever bar carrying the cam follower, a lever member to which the lever bar is pivoted and which is itself connected pivotally relative to the platen, and a releasable latch for connecting the lever bar to the lever member so that the lever bar and lever member move together, and wherein the brick press includes a formation on the cam surface for engaging and stopping the cam follower at a certain stage during pivoting of the lever, the cam follower then acting as a fulcrum for the lever bar when the latch is released so that subsequent pivotal movement of the lever bar in the first direction causes levered movement of the lever member resulting in movement of the platen further towards the lid to apply final compression to the material in the pressing chamber.

3. A brick press according to claim 2 wherein the lever is operable, with the lid in said open position, to apply a levering action to the platen to move the platen in a direction to drive the compressed material, in the form of a brick, out of the pressing chamber.

4. A brick press according to claim 3 comprising a frame supporting the pressing chamber and a formation on the frame acting as a fulcrum for the lever, when the lever is pivoted relative to the platen in a second direction opposite to the first direction, so that the lever applies a levering action to the platen to cause the platen to drive the compressed material, in the form of a brick, out of the pressing chamber.

5. A brick press according to claim 3 wherein the lever has laterally projecting handles whereby the lever can be gripped and operated manually.

6. A brick press according to claim 3 and comprising upright void-forming guides in the brick pressing chamber, the void-forming guides passing through the platen to guide movement of the platen.

7. A brick press according to claim 6 wherein the lid has apertures therein in which the void-forming guides locate when the lid is in its closed position.

8. A brick press according to claim 7 and comprising bearings mounted slidably on the void-forming guides and connected to the platen, the lever being connected pivotally to the bearings.

9. A brick press according to claim 3 wherein the platen and the lid carry relief formations adapted to form three-dimensional interlocking formations on opposite surfaces of a brick pressed in the brick press.

* * * * *